US006743351B1

(12) United States Patent
Arai et al.

(10) Patent No.: US 6,743,351 B1
(45) Date of Patent: Jun. 1, 2004

(54) METHOD AND APPARATUS FOR PRODUCING CLEANING AGENT

(75) Inventors: Kazuyoshi Arai, Fujisawa (JP); Kazuhiro Miyamae, Fujisawa (JP); Tomoki Seo, Fujisawa (JP)

(73) Assignee: MIZ Co., Ltd., Kanagawa (JP)

( * ) Notice: Subject to any disclaimer, the term of this patent is extended or adjusted under 35 U.S.C. 154(b) by 0 days.

(21) Appl. No.: 09/554,617

(22) PCT Filed: Oct. 4, 1999

(86) PCT No.: PCT/JP99/05447

§ 371 (c)(1),
(2), (4) Date: Aug. 23, 2000

(87) PCT Pub. No.: WO99/37414

PCT Pub. Date: Jul. 29, 1999

(30) Foreign Application Priority Data

Oct. 5, 1998 (JP) ..... 10-282767
Jul. 27, 1999 (JP) ..... 11-211811

(51) Int. Cl.[7] ..... C02L 1/461
(52) U.S. Cl. ..... 205/701; 205/742; 205/746
(58) Field of Search ..... 205/701, 742, 205/746

(56) References Cited

U.S. PATENT DOCUMENTS

| | | | |
|---|---|---|---|
| 3,339,737 A | | 9/1967 | Kiscellus et al. |
| 3,937,042 A | | 2/1976 | Loeb |
| 3,985,669 A | | 10/1976 | Krummel et al. |
| 4,472,287 A | | 9/1984 | Ramachandran et al. |
| 4,530,774 A | | 7/1985 | Davies et al. |
| 4,605,509 A | | 8/1986 | Corkill et al. |
| 4,793,942 A | | 12/1988 | Lokkesmoe et al. |
| 4,911,856 A | | 3/1990 | Lokkesmoe et al. |
| 5,443,751 A | * | 8/1995 | Mazzola |
| 6,461,446 B1 | | 10/2002 | Satoh et al. |
| 6,596,092 B1 | | 7/2003 | Satoh et al. |

FOREIGN PATENT DOCUMENTS

| | | | |
|---|---|---|---|
| EP | 0503589 | | 9/1992 |
| JP | 63205196 | | 8/1988 |
| JP | 08112573 A | * | 7/1996 |
| WO | 99/37414 | | 7/1999 |
| WO | 00 20549 | | 4/2000 |

OTHER PUBLICATIONS

Machine translation of the above Japanese patent.*
English Language Abstract of WO 00/20549.

* cited by examiner

*Primary Examiner*—Arun S. Phasge
(74) *Attorney, Agent, or Firm*—Greenblum & Bernstein, P.L.C.

(57) ABSTRACT

A solution containing at least one of carbonate and bicarbonate of alkali metal, for example, a sodium hydrogen carbonate solution, as a solution to be electrolyzed is electrolyzed, and the obtained electrolytic water is used as an undiluted detergent. In the electrolysis process, a sodium hydrogen carbonate solution is supplied at least to an anode chamber of an electrolysis cell having a cathode chamber and an anode chamber separated by a diaphragm to carry out electrolysis, and the obtained cathode water or anode water is used as an undiluted detergent; or a sodium hydrogen carbonate solution is supplied to both of an anode chamber and a cathode chamber of the electrolysis cell to carry out electrolysis, and the obtained cathode water is used as an undiluted detergent; or a sodium hydrogen carbonate solution is supplied at least to an anode chamber of the electrolysis cell to carry out electrolysis, and the obtained cathode water or anode water is further added and dissolved sodium hydrogen carbonate and the obtained solution is used as an undiluted detergent; or a sodium hydrogen carbonate solution is supplied at least to an anode chamber of the electrolysis cell to carry out electrolysis, and the obtained cathode water and anode water is mixed after completion of the electrolysis and the obtained solution is used as an undiluted detergent.

19 Claims, 4 Drawing Sheets

METHOD AND APPARATUS FOR PRODUCING CLEANING AGENT

TECHNICAL FIELD

The present invention relates to a new washing process and a washing apparatus suitable to washing clothes, tableware, medical equipments and washing hands, etc.

BACKGROUND OF THE INVENTION

Surfactant, such as chemicals and soup, has been heretofore been used for washing clothes, tableware, medical equipment, toilets, etc., however, there have been problems of causing chapping hands when washing, a safety issue on body by residual detergent on washing items, and residual harmful substances after a treatment of discharging water, etc.

Inventors of the present invention proposed a method of washing washing items while softening washing water containing at least one of carbonate ion or bicarbonate ion and alkali metal ion (refer to PCT/JP99/00242, WO99/37414). This directs attention to the fact that a composite generated at the time of softening a solution containing alkali metal ion and carbonate ion and/or bicarbonate ion realizes cleansing effect and adsorption effect, which shows detergency comparable to or more excellent than the conventional detergent such as surfactant and becomes human body-friendly and environment-friendly.

However, when trying to produce a solution containing alkali metal ion and carbonate ion and/or bicarbonate ion as an undiluted detergent it is necessary to use as its material a substance having a problem on handle ability such as sodium hydroxide, thus there has been a problem to carry out at home from producing detergent to washing.

DISCLOSURE OF INVENTION

The present invention has as an object thereof to provide a method of enabling to produce detergent only by substances superior in being handled and an apparatus therefor.

(1) According to a first aspect of the present invention, a method of producing detergent includes a step of electrolyzing a solution containing at least one of carbonate and bicarbonate of alkali metal.

Namely, as shown in FIG. 1, by making a solution of a substance containing at least one of carbonate and bicarbonate of alkali metal (see Step 1 to 2 in FIG. 1) and by electrolyzing the solution (see Step 3 in FIG. 1), an undiluted detergent can be obtained (see Step 4 in FIG. 1).

By electrolyzing a solution containing at least one of carbonate and bicarbonate of alkali metal, for example, a solution of substances superior in handle ability such as sodium carbonate, potassium carbonate, lithium carbonate, potassium hydrogen carbonate, sodium hydrogen carbonate, as a solution to be electrolyzed, it is possible to obtain an undiluted detergent containing alkali metal ion and carbonate ion and/or bicarbonate ion, and by washing as softening the same, it shows detergency comparable to or better than the conventional detergent, such as surfactant, and becomes human body-friendly and environment-friendly. Accordingly, a series of procedures from producing detergency to washing can be realized at home.

As alkali metal carbonate according to the present invention, for example, sodium carbonate $Na_2CO_3$, potassium carbonate $K_2CO_3$, lithium carbonate $Li_2CO_3$, etc. can be listed, while as alkali metal bicarbonate, for example, potassium hydrogen carbonate $KHCO_3$, sodium hydrogen carbonate $NaHCO_3$, etc. can be listed.

Also, when making a solution of carbonate or bicarbonate of alkali metal, a variety of kinds of water may be used, such as tap water, well water, soft water, refined water, pure water, or mixed water of these, etc.

(2) Although, it is often the case that a pH, etc. of detergent to be used differ in accordance with a property of washing items, in the present invention, when producing detergent by electrolyzing a solution containing at least one of carbonate and bicarbonate of alkali metal, it is possible to adopt forms below in accordance with an aimed potential of hydrogen (pH=6 to 12) of the detergent.

As a first embodiment, cathode water or anode water obtained by electrolyzing by supplying the above solution to be electrolyzed at least to an anode chamber of an electrolyzing cell having a cathode chamber and an anode chamber separated by a diaphragm can be used as an undiluted detergent (see FIG. 4A). The cathode water obtained by this form becomes an alkaline undiluted detergent having a high pH.

In this case, as a second embodiment, when cathode water obtained by electrolyzing by supplying the above solution to be electrolyzed to both of the anode chamber and the cathode chamber of the electrolyzing cell having a cathode chamber and an anode chamber separated by a diaphragm is used as an undiluted detergent, it is possible to obtain a highly concentrated undiluted detergent wherein rising of the pH is suppressed (see FIG. 4B).

Also, as a third embodiment, cathode water or anode water obtained by electrolyzing by supplying the above solution to be electrolyzed at least to an anode chamber of an electrolyzing cell having a cathode chamber and an anode chamber separated by a diaphragm or mixture of the both water is further added and dissolved at least one of carbonate and bicarbonate of alkali metal after completing the electrolysis and thus obtained solution can be used as an undiluted detergent (see FIG. 4C).

Furthermore, as a fourth embodiment, by electrolyzing by supplying the above solution to be electrolyzed at least to an anode chamber of an electrolyzing cell having a cathode chamber and an anode chamber separated by a diaphragm, and mixing the obtained cathode water or anode water after the electrolysis is completed, the thus obtained solution can be used as an undiluted detergent (see FIG. 4D).

In this case, as a fifth embodiment, it is also possible to use as an undiluted detergent mixture of cathode water or anode water obtained by electrolyzing by supplying the solution to be electrolyzed to both of the anode chamber and the cathode chamber of the electrolyzing cell having a cathode chamber and an anode chamber separated by a diaphragm (see FIG. 4E).

In the fourth and fifth embodiments, since the mixture of the anode water and the cathode water becomes an undiluted detergent, a production amount of the obtained undiluted detergent becomes doubled, or otherwise, the capacity of the electrolysis cell can be halved.

The cathode water in the first embodiment, the cathode water in the second embodiment, the cathode water in the third embodiment, the mixed water in the fourth embodiment and the mixed water in the fifth embodiment have a pH of 9.5 to 12.0 and can be used as an alkaline undiluted detergent.

On the other hand, the anode water in the first embodiment and the anode water in the third embodiment have a pH of 6 to 8 and can be used as a neutral undiluted detergent.

In a method of producing detergent of the present invention, the pH and electric conductivity can be easily adjusted by suitably setting the conditions of electrolysis.

(3) The above undiluted detergent can be used for washing as it is or diluted (see Step 5 to 6 in FIG. 1. Hereinafter, also referred to as a diluted detergent A). An electric conductivity of the diluted detergent is 100 mS/m or more, preferably, 150 mS/m or more.

Also, a variety of washing aid agents for improving detergency, etc. can be added (see Step 9 in FIG. 1).

Namely, the above alkaline detergent can be added fatty acid or soap, such as oleic acid or oleic acid potassium, at the time of or after being diluted by water, to be used as detergent.

Also, the above neutral detergent can be added a variety of washing aid agents to be used as detergent, such as antisoil redeposition (for example, carboxyl methyl cellulose), nonionic surfactant (for example, sugar fatty acid ester, polyoxyethylene sorbitan fatty acid ester), dispersing agents (for example, carboxyl methyl cellulose) and water softening agents (for example, EDTA, citric acid).

Auxiliary/aid agents used in the present invention are emulsifier (surfactant) used for food processing and gum/thickening agent as food additives, and by not using the conventional surfactant for washing, safer detergent can be provided. Furthermore, since the detergency is given to the electrolytic water obtained by electrolysis of a solution of alkali metal carbonate/bicarbonate, the surfactant can be made to be minimum thickness required for antisoil redeposition, and it becomes possible to reduce a burden on an environment by suppressing usage of organic substances.

(4) Note that the present invention may include a step of softening the detergent containing at least one of carbonate ion and bicarbonate ion and alkali metal ion, particularly the above undiluted detergent or the diluted detergent A (see Steps 7 to 8. Hereinafter, the obtained detergent will be also referred to as diluted detergent B).

In this case, it is preferable to adopt a means to make it contact solid carbonate composite which is water-insoluble or hard to be dissolved in water.

(5) Further, according to a second aspect of the present invention, an electrolysis cell wherein an anode chamber and a cathode chamber are separated by a diaphragm, a solution tank for making a solution by dissolving at least carbonate or bicarbonate of alkali metal in water, a detergent producing apparatus having a first supply means for supplying the solution in the solution tank at least to the anode chamber of the electrolysis cell and a mixing means for mixing anode water and cathode water respectively generated in the anode chamber and the cathode chamber to make mixed electrolytic water after completion of the electrolysis are provided.

In this case, preferably, the mixing means comprises a water tank for storing anode water and cathode water after completion of the electrolysis and a second-supply means for supplying the anode water and cathode water generated in said anode chamber and cathode chamber to said water tank.

Also, there is provided a detergent producing apparatus, comprising an electrolysis cell wherein an anode chamber and a cathode chamber separated by a diaphragm, a solution tank for making a solution by dissolving at least one of carbonate and bicarbonate of alkali metal in water, a first supply means for supplying the solution in said solution tank at least to the anode chamber of said electrolysis cell, a detergent tank for storing detergent discharged from said electrolysis cell, and a third supply means for supplying one of cathode water after completing the electrolysis generated in said cathode chamber and anode water after completing the electrolysis generated in said anode chamber to said detergent tank.

In this case, it is preferable to comprise a means for adding and dissolving at least one of carbonate and bicarbonate of alkali metal to at least one of anode water generated in said anode chamber and cathode water generated in said cathode chamber.

(6) According to a third aspect of the present invention, there is provided a washing machine comprising a detergent producing apparatus for producing detergent by electrolyzing a solution containing at least one of carbonate and bicarbonate of alkali metal; a detergent tank for storing said detergent; a washing tub for washing; a means for supplying diluting water of said detergent to said washing tub; and a means for supplying said detergent from said detergent tank to said washing tub.

In this case, it is preferable to further comprises a judgement means for judging an amount of washing items and/or an amount of washing water in said washing tub and a setting means for setting the amount of washing items and the amount of washing water; and a control means for outputting to said detergent supply means a control signal for supplying the washing tub an appropriate amount of detergent for washing based on an output signal from said judgement means or said setting means.

Furthermore, it is preferable to comprise a container for storing washing aid agents, a means for supplying washing aid agents from said container to said washing tub, and a control means for outputting to said supply means of washing aid agent a control signal for supplying an appropriate amount of the washing aid agents for washing to the washing tub.

(7) The above detergent producing apparatus or washing apparatus can be applied to a washing machine, dish washer, etc.

BEST MODE FOR CARRYING OUT THE INVENTION

Figure 3:
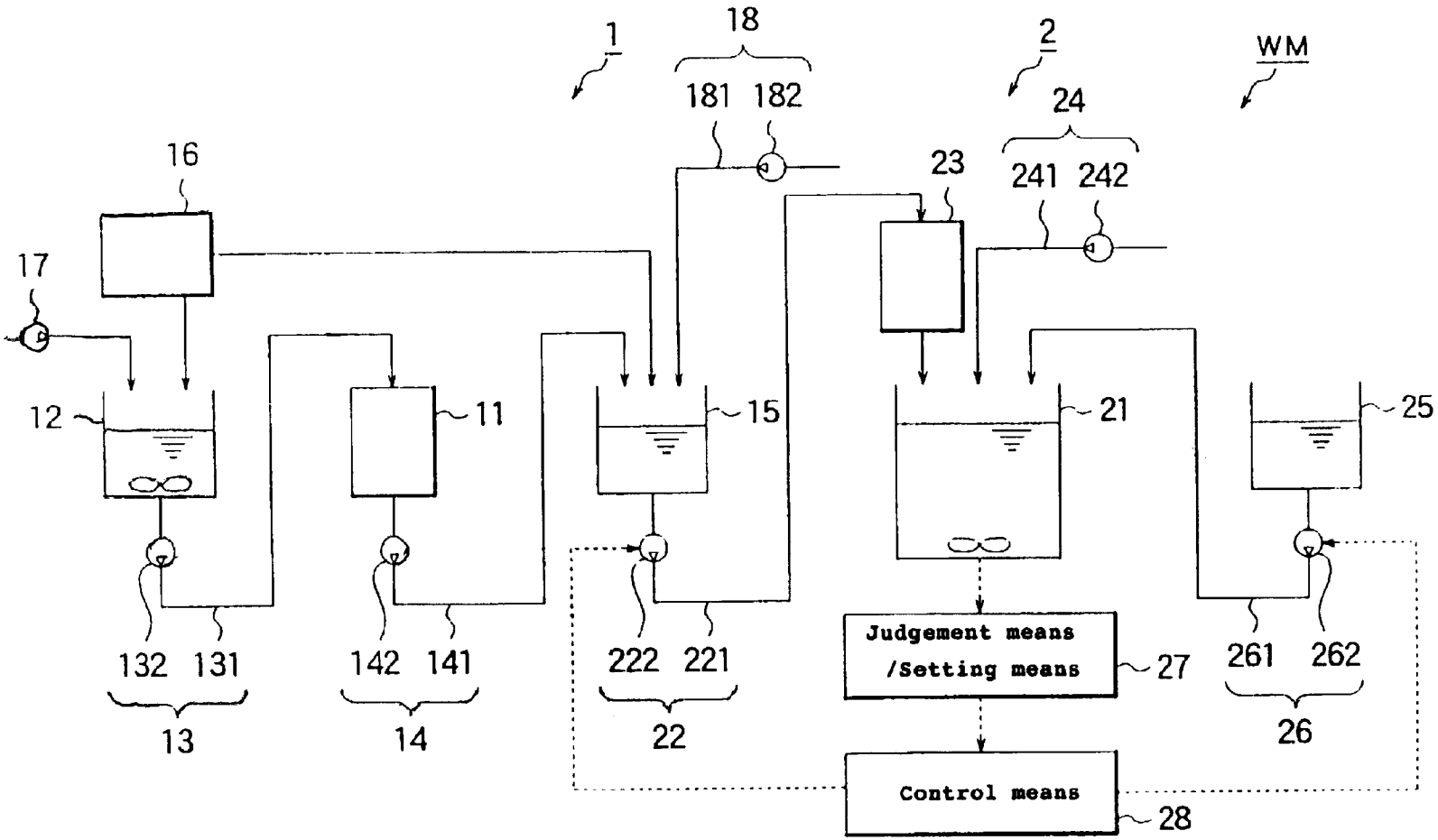
FIG. 3 is a schematic view of an embodiment of a washing apparatus of the present invention.

First, an embodiment of applying a detergent producing apparatus of the present invention to a washing machine will be explained. FIG. 3 is a schematic view of an example of a washing machine WM wherein a detergent producing apparatus of the present invention is applied, and details of an electrolysis cell 11 shown in the same figure will be explained with reference to FIGS. 4A to 4E.

The detergent producing apparatus 1 of the present embodiment comprises a solution tank 12 for storing-alkali metal sodium solution containing at least one of alkali metal carbonate and alkali metal bicarbonate (hereinafter, also referred to as a solution to be electrolyzed), an electrolysis cell 11 and a first supply system 13 for supplying the solution to be electrolyzed from the solution tank 12 to the electrolysis cell 11.

The solution tank 12 is supplied a substance containing at least one of alkali metal carbonate and alkali metal bicarbonate (sodium hydrogen carbonate in this example) from a container 16 storing the same and tap water, etc. from a tap water source, etc. via a supply system 17. An example below is for explaining a case of using sodium hydrogen carbonate.

As shown in FIGS. 4A to 4E, the electrolysis cell 11 is formed an inlet 111 for being introduced a solution to be electrolyzed and an outlet 112 for taking out generated electrolytic water, and an electrolysis chamber 113 is formed between the inlet 111 and the outlet 112.

Also, at the approximate center of the electrolysis chamber 113 is provided with a diaphragm 114 formed by a cation exchange film, and both electrolysis chambers 113*a* and 113*c* over the diaphragm 114 are respectively provided with a pair of electrode plates 115*a* and 115*c* facing to each other. Here, while not illustrated, the pair of electrode plates 115*a* and 115*c* are connected to a direct current power source, and one electrode plate 115*a* is to be applied the anode while the other electrode plate 115*c* is to be applied the cathode. Below, the electrolysis chamber 113*a* will be also referred to as an anode chamber, the electrolysis chamber 113*c* a cathode chamber, electrolytic water generated in the anode chamber an anode water, and electrolytic water generated in the cathode chamber a cathode water.

As the diaphragm 114, a variety of ion exchange films, nonionic selective films, multi-porous films may be used. These films are provided for preventing anode water generated around the anode and cathode water generated around the cathode from being mixed. In the case of using a cation exchange film as in the present example, less hydroxide ion generated in the cathode chamber 113*c* transmits to the anode chamber 113*a*, so that it is preferable because it becomes easy to refrain the pH of the obtained undiluted detergent of anode water from becoming alkaline, and to heighten the pH of the cathode water to be obtained to produce a strong alkaline undiluted detergent of cathode water.

As the electrode plates 115*a* and 115*c*, it is preferable to be configured by materials not melted by electricity. Specifically, for example, platinum family metals, titanium, etc. have excellent corrosion resistance and preferably used. The distance between the electrode plates 115*a* and 115*c* is 1 mm to 6 mm, more preferably, 5 mm.

Figure 4A:
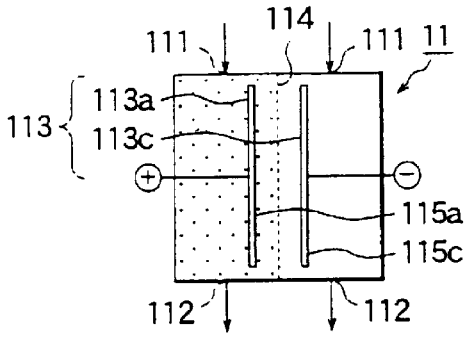
FIGS. 4A to 4E are views of respective use forms of an electrolysis cell of FIG. 3.

Further, to explain use forms the electrolysis cell 11 shown in FIGS. 4A to 4E, in FIG. 4A, the anode chamber 113*a* is supplied a solution of sodium hydrogen carbonate from the solution tank 12, while the cathode chamber 113*c* is supplied tap water, etc. Both of anode water generated in the anode chamber 113*a* and cathode water generated in the cathode chamber 113*c* may be used as undiluted detergent. According to this use form, little hydroxide ion generated in the cathode chamber 113*c* transmits to the anode chamber 113*a*, so it is possible to refrain the pH of the undiluted detergent of anode water from becoming alkaline, and it becomes easy to heighten the pH of cathode water to be obtained and to produce a strong alkaline undiluted detergent of cathode water.

Figure 4B:
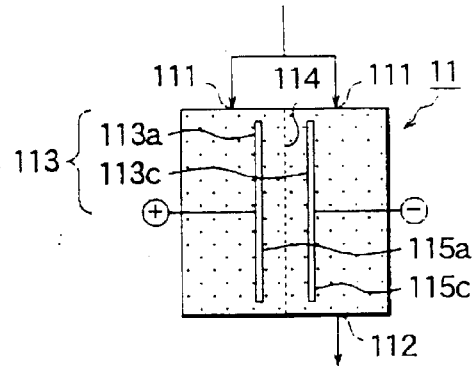

On the other hand, in the use form shown in FIG. 4B, although sodium hydrogen carbonate solution is supplied to both the anode chamber 113*a* and the cathode chamber 113*c* from the solution tank 12, only cathode water generated in the cathode chamber 113*c* is used as undiluted detergent. In this case, since a sodium hydrogen carbonate solution is supplied to the cathode chamber 113*c*, the undiluted detergent of cathode water to be obtained is suppressed not to rise the pH, so that weak alkaline undiluted detergent can be obtained and highly concentrated undiluted detergent can be generated.

Figure 4C:
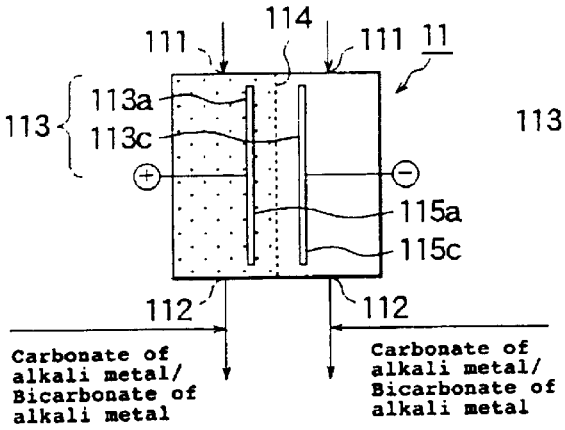

Also, the use form shown in FIG. 4C is a modified example of the one shown in FIG. 4A, and the anode chamber 113*a* is supplied sodium hydrogen carbonate solution from the solution tank 12 while the cathode chamber 113*c* is supplied tap water, etc., and obtained anode water and cathode water are respectively further added with at least one of sodium carbonate and sodium hydrogen carbonate to become an undiluted detergent. According to this use form, it is possible to adjust the pH and concentration of the anode water and cathode water respectively obtained in the anode chamber 113*a* and the cathode chamber 113*c* after the electrolysis.

Figure 4D:
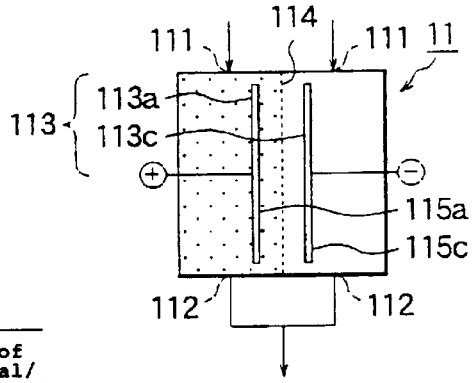

Furthermore, the use form shown in FIG. 4D is also a modified example of the one shown in FIG. 4A, wherein also the anode chamber 113*a* is supplied sodium hydrogen carbonate solution from the solution tank 12 while the cathode chamber 113*c* is supplied tap water, etc., but the obtained anode water and the cathode water are mixed to be an undiluted detergent. According to this use form, since all of the anode water and the cathode water are used, the production amount of the undiluted detergent to be obtained is doubled, or otherwise, the capacity of the electrolysis cell 11 may be halved.

Figure 4E:
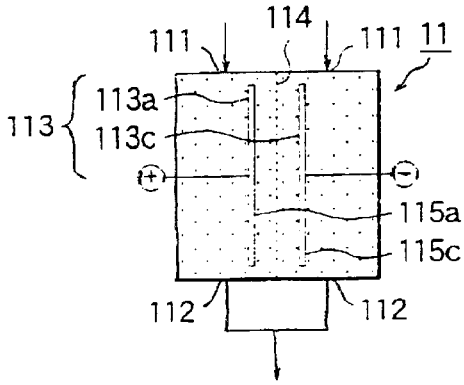

Also, the use form shown in FIG. 4E is a modified example of the one shown in FIG. 4D, wherein both of the anode chamber 113*a* and the cathode chamber 113*c* are supplied sodium hydrogen carbonate solution from the solution tank 12, and the obtained anode water and the cathode water are mixed to be an undiluted detergent. According to this use form, all of the anode water and the cathode water are used, so the production amount of the undiluted detergent to be obtained is doubled, or the capacity of the electrolysis cell 11 may be halved.

Figure 2:
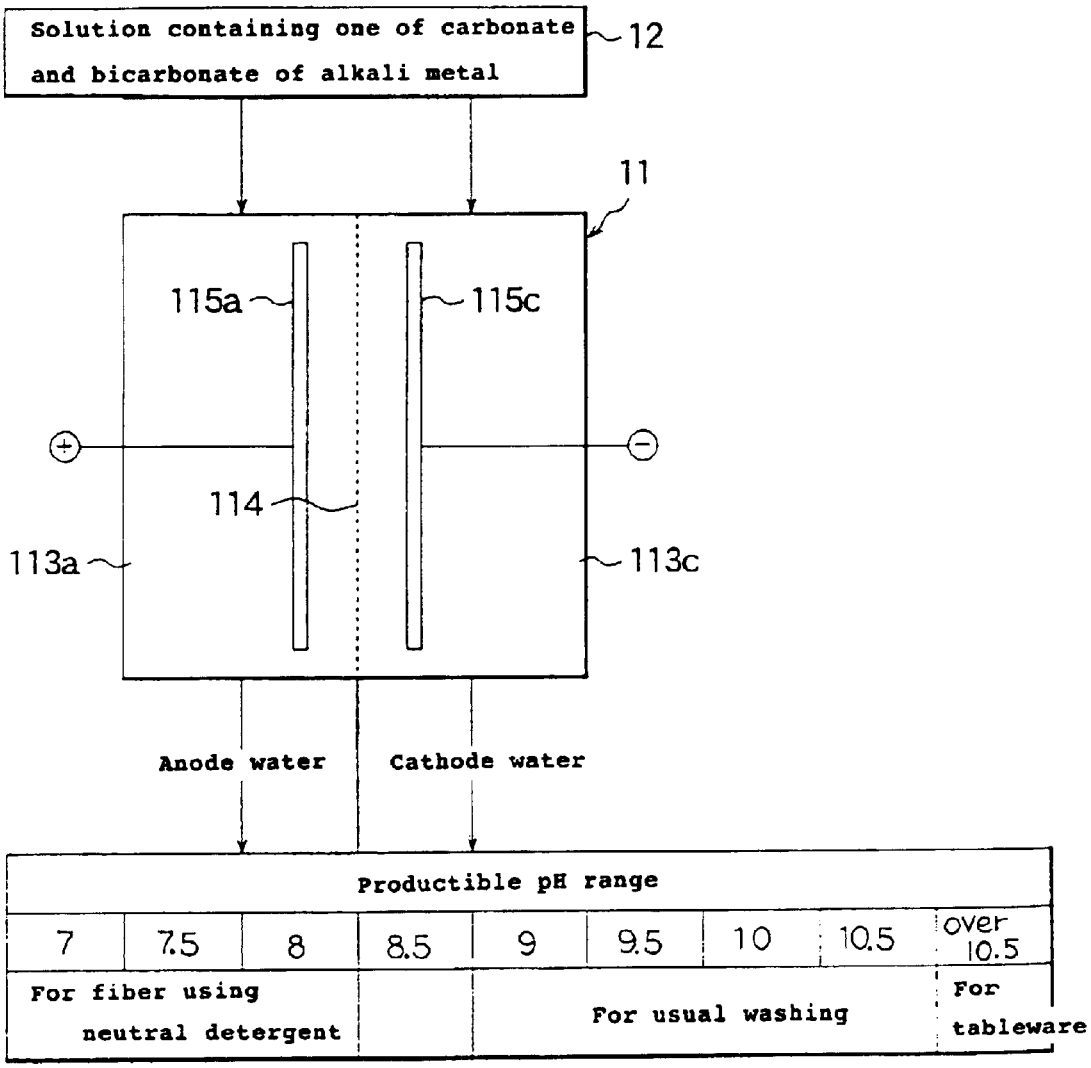
FIG. 2 is a view of a pH range of detergent obtained by a method of producing detergent of the present invention.

As explained above, according to the electrolysis 11 of the present invention, a variety of aimed undiluted detergent can be obtained by suitably changing the use form. The states are schematically shown in FIG. 2.

Returning to FIG. 3, the first supply system 13 is provided with a pipe 131 for connecting a solution tank 12 to the inlet 111 of the electrolysis cell 11 and a pump 132 for sending by pressure the solution to be electrolyzed in the solution tank 12 to the electrolysis cell 11.

Furthermore, the detergent producing apparatus 1 of the present embodiment comprises a detergent tank 15 for storing electrolytic water generated in the anode chamber 113*a* and/or the cathode chamber 113*c* of the electrolysis cell 11, a second supply system 14 for supplying the electrolytic solution from the electrolysis cell 11 to the detergent tank 15, and a diluting means 18 for diluting the undiluted detergent generated in the electrolysis cell 11.

The second supply system 14 is comprised by a pipe 141 for connecting the outlet 112 of the electrolysis cell 11 to the detergent tank 15 and a pump 142 provided on the pipe 141 for sending by pressure the electrolytic solution generated in the electrolysis cell 11 to the detergent tank 15.

Note that in the use form shown in FIG. 4C, when adding sodium hydrogen carbonate to the anode water or cathode water generated in the electrolysis cell 11 later on, it is sufficient to supply it from the container 16 shown in FIG. 3.

Also, the diluting means 18 is comprised by a supply pipe 181 for supplying diluting water from a not shown tap water source to the detergent tank 15 and a pump 182 by which the undiluted detergent is diluted by a predetermined diluting rate to become diluted detergent A.

The above detergent producing apparatus 1 is provided to a washing machine body 2 having a washing tub 21. It further comprises a third supply system 22 for supplying electrolytic water (diluted detergent A) stored in the detergent tank 15 to the washing tub 21 via a water softening filter 23. The third supply system 22 is comprised by a pipe 221 for connecting the detergent tank 15 to the water softening filter 23 and a pump 222 provided on the pipe 221 for sending by pressure the diluted detergent A stored in the detergent tank 15 to the water softening filter 23.

Figure 1:
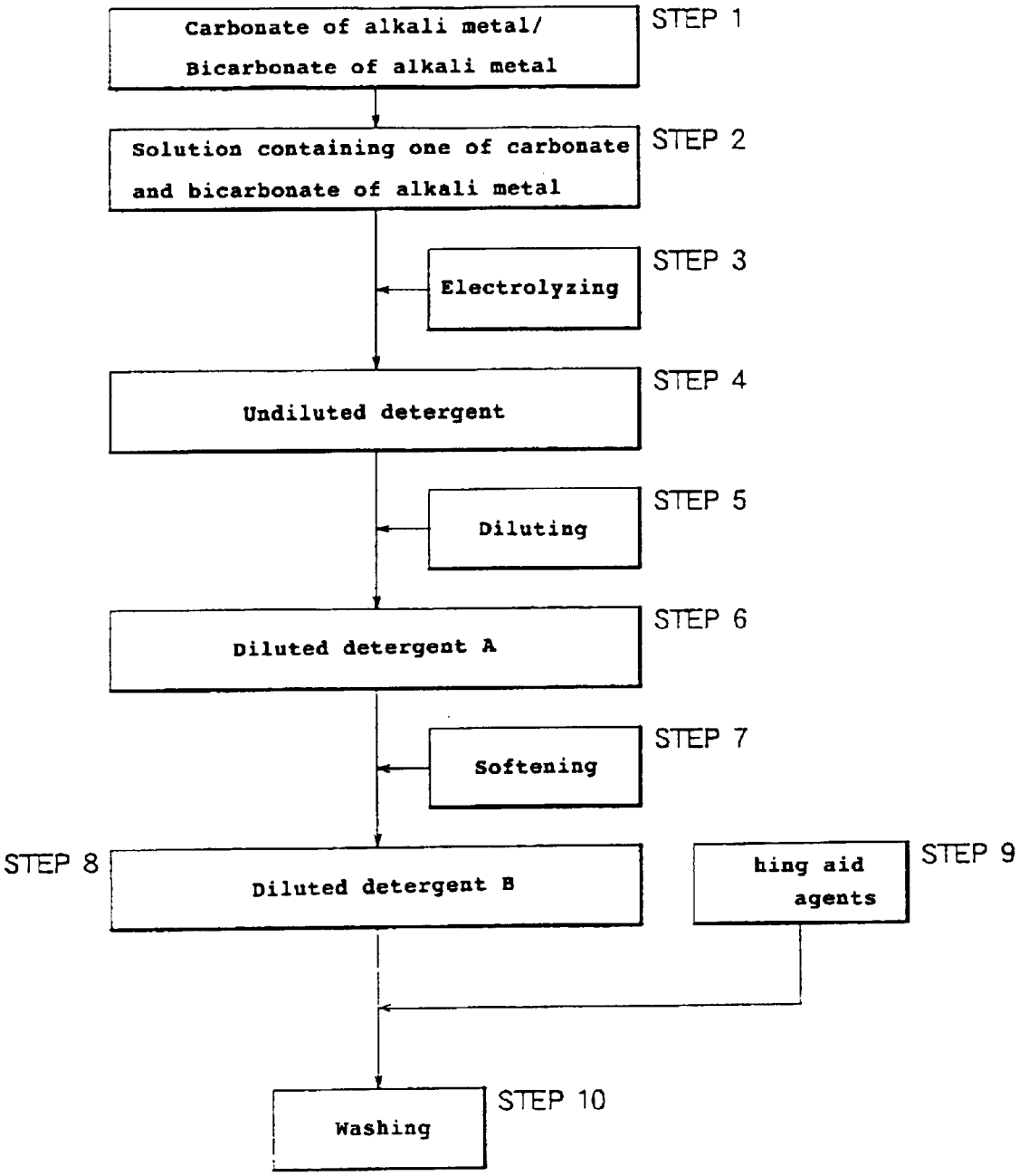
FIG. 1 is a view of processes of an embodiment of a method of producing detergent of the present invention.

The water softening filter 23 is provided in this example for softening the undiluted detergent (see Step 4 in FIG. 1) as it is obtained by the detergent producing apparatus 1 or diluted detergent A after diluting (see Step 6 in FIG. 1).

In the water softening filter 23, inside its casing is filled with solid hydroxide composite which is insoluble or hard to be dissolved in water, for example, calcium carbonate or calcium phosphate, and by making the above undiluted detergent and diluted detergent contact such carbonate composites, calcium ion and magnesium ion included in the undiluted detergent and diluted detergent are educed as calcium carbonate and magnesium carbonate, and thereby, the detergent can be made to be low in hardness. Note that the carbonate composite may be in a suitably granulated ball shape or pelletized form other than powder and a crushed shape, and may include filling agents and amount increasing agents other than carbonate composite. Also, the solid carbonate composite is sufficient if at least the surfaces thereof are carbonate composite, and may be a compound body wherein a suitable core body is covered with carbonate composite.

Returning back to FIG. 3, the washing tub 21 is provided with a fourth supply system 24 for supplying tap water, etc. for diluting the detergent, and the fourth supply system 24 is configured by a pipe 241, a pump 242 and a not shown tap water supplying source.

Furthermore, the washing-machine WM of the present embodiment is provided with a washing aid agent tank 25 for storing a variety of washing aid agents, such as antisoil redeposition (for example, carboxyl methyl cellulose), nonionic surfactant (for example, sugar fatty acid ester, polyoxyethylene sorbitan fatty acid ester), dispersing agents (for example, carboxyl methyl cellulose) and water softening agents (for example, EDTA, citric acid), and a fifth supply system 26 for supplying the washing aid agents stored in the washing aid agent tank 25 to the washing tub 21. The fifth supplying system 26 is configured by a pipe 261 and a pump 262.

Furthermore, the washing machine WM of the present embodiment is provided as a control system with a judgement/setting means 27 for detecting and judging or manually setting an amount of washing items put in the washing tub 21 or an amount of washing water filled in the washing tub 21 and a control means 28 for controlling the operations of the pumps 222 and 262 based on the amounts of washing items or washing water input to the means 27. As a result, detergent and washing aid agents in accordance with the washing load are supplied respectively from the detergent tank 15 and the washing aid agent tank 25 to the washing tub 21.

Next, an example of washing process using the above washing machine WM will be explained.

First, an anode of a direct current power source of the detergent producing apparatus 1 is connected to the electrode plate 115*a*, while a cathode is connected to the electrode plate 115*c*, and a direct current voltage is applied to the both electrode plates 115*a* and 115*c*. Then, the pump 132 is operated to introduce sodium hydrogen carbonate solution as the solution to be electrolyzed from the solution tank 12 to the inlet 111. As a result, electrolysis is carried out in both of the electrolysis chambers 113*a* and 131*c*, and after a certain period of time, electrolytic solution is discharged from the respective outlets 112. These electrolytic waters are supplied to the detergent tank 15 by the pump 142 via the pipe 141, mixed during the time and becomes an undiluted detergent of the present invention.

The undiluted detergent stored in the detergent tank 15 is diluted by the diluting means 18, and then supplied to the water softening filter 23, wherein it is softened, and supplied to the washing tub 21 of the washing machine WM.

At this time, amounts of detergent and washing aid agents to be supplied are controlled in accordance with the amount of washing items. Namely, when the judging means automatically detects or setting means 27 is manually input the amount of washing items (for example, the weight, volume, etc.) put in the washing tub 21 and the amount of tap water poured in the washing tub 21, a signal is sent to the control means 28 and a signal of operation time, etc. in accordance with the washing load is sent therefrom to the pumps 222 and 262. As a result, the washing tub 21 is supplied an appropriate amount of detergent and washing aid agents in accordance with the washing load.

A specific example of producing detergent by the present invention will be explained next.

Embodiment 1 (FIG. 4A)

A saturated solution of sodium hydrogen carbonate prepared by dissolving and diluting 100 g of sodium hydrogen carbonate in 1 litter of tap water (municipal tap water in Fujisawa city, pH 7.2, EC 15.5 mS/m, water temperature 24.5° C.) was supplied to the anode chamber 113*a* of the batch type electrolysis cell 11 (a capacity of the anode chamber and the cathode chamber are both 0.5 litter) shown in FIG. 4A, and the above tap water was supplied to the cathode chamber 113*c* shown in the same figure. Then, electrolysis was carried out by applying a direct current voltage so that a constant current of 20A flows to both the electrode plates 115*a* and 115*c*, and pH and electric conductivity EC of an undiluted solution of cathode water obtained at every five minutes and a diluted solution by diluting the same to be thirty times (30 litters) were measured. Measurement of the diluted water was made after mixing for one minute. The result will be shown in Table 1.

Note that a pH was measured by using a pH meter (trade name of D-13, manufactured by Horiba Ltd.), an EC was measured by using an EC meter (trade name of CM-14P, manufactured by TOA Corporation). The mark * of EC in the table indicates it exceeded the measurable limit (1999 mS/m or less).

Both of the undiluted detergent and diluted detergent A obtained in the present embodiment become alkaline having a pH of 10.5 or more, and those which had a long electrolysis time became detergent having strong alkaline and the EC value of 100 mS/m or more, so that it becomes preferable to be used as detergent for non fibrous washing items, such as tableware.

TABLE 1

| | undiluted electrolytic solution | | diluting water | |
|---|---|---|---|---|
| | pH | EC (mS/m) | pH | EC (mS/m) |
| before electrolysis | 7.23 | 15.5 | — | — |
| after 3 min. | 12.64 | 2000 or more * | 10.53 | 47.1 |
| after 5 min. | 12.88 | 2000 or more * | 10.92 | 59.6 |
| after 10 min. | 13.05 | 2000 or more * | 11.34 | 87.2 |
| after 15 min. | 13.20 | 2000 or more * | 11.79 | 133.0 |
| after 20 min. | 13.35 | 2000 or more * | 12.26 | 180.3 |

Embodiment 2 (FIG. 4B)

A solution prepared by dissolving and diluting 36 g of sodium hydrogen carbonate in 1 litter of tap water (municipal tap water in Fujisawa city, pH 7.3, EC 17.9 mS/m, water temperature 20.2° C.) was supplied to the cathode chamber 113*c* of the batch type electrolysis cell 11 (a capacity of the anode chamber and the cathode chamber are both 1 litter) shown in FIG. 4B, and saturated solution of sodium hydrogen carbonate was supplied to the anode chamber 113*a*. Then, electrolysis was carried out by applying a direct current voltage so that a constant current of 15A flows to both of the electrode plates 115*a* and 115*c*, and a pH and electric conductivity EC of an undiluted solution of cathode water obtained at every ten minutes and a diluted solution by diluting the same to be thirty times (30 litters) were measured. Measurement of the diluted water was made after mixing for one minute. The result will be shown in Table 2.

Both of the undiluted detergent and diluted detergent A obtained in the present embodiment become weak alkaline of a pH of 9.0 to 10.5, and the EC value of 100 mS/m or more, so that it becomes preferable to be used as detergent for fibrous washing items, such as cotton, hemp, rayon, polynosic, polyester, nylon and acryl.

TABLE 2

| | undiluted electrolytic solution | | diluting water | |
|---|---|---|---|---|
| | pH | EC (mS/m) | pH | EC (mS/m) |
| before electrolysis | 8.02 | 2000 or more * | 8.20 | 120.3 |
| after 10 min. | 9.36 | 2000 or more * | 9.52 | 140.3 |
| after 20 min. | 9.65 | 2000 or more * | 9.94 | 168.0 |
| after 30 min. | 9.98 | 2000 or more * | 10.23 | 196.9 |
| after 36 min. | 10.20 | 2000 or more * | 10.44 | 204.0 |

Embodiment 3 (FIG. 4E)

A solution prepared by dissolving and diluting 36 g of sodium hydrogen carbonate in 2 litters of tap water (municipal tap water in Fujisawa city, pH 7.3, EC 18.5 mS/m, water temperature 20.6° C.) was divided to be 1 litter and respectively supplied to the anode chamber 113*a* and the cathode chamber 113*c* of the batch type electrolysis cell 11 (a capacity of the anode chamber and the cathode chamber are both 1 litter) shown in FIG. 4E. Then, electrolysis was carried out by applying a direct current voltage so that a constant current of 15A flows to both the electrode plates 115*a* and 115*c*, and a pH and electric conductivity EC of mixture of an undiluted solution of anode water and cathode water obtained at every ten minutes and a diluted solution by diluting the same to be thirty times (30 litters) were measured. Measurement of the diluted water was made after mixing for one minute. The result will be shown in Table 3.

Both of the undiluted detergent and diluted detergent A obtained in the present embodiment became weak alkaline of a pH of 8.5 to 10.5, and the EC value of 100 mS/m or more, so that it becomes preferable to be used as detergent for fibrous washing items, such as cotton, hemp, rayon, polynosic, polyester, nylon and acryl.

TABLE 3

| | undiluted electrolytic solution | | diluting water | |
|---|---|---|---|---|
| | pH | EC (ms/m) | pH | EC (ms/m) |
| before electrolysis | 8.06 | 1460 | 8.13 | 121.3 |
| after 5 min. | 8.72 | 1455 | 8.84 | 119.3 |
| after 15 min. | 9.56 | 1492 | 9.68 | 120.9 |
| after 25 min. | 10.21 | 1531 | 10.25 | 126.7 |

Embodiment 4 (FIG. 4E)

A solution prepared by dissolving and diluting 72 g of sodium hydrogen carbonate in 1 litter of tap water (municipal tap water in Fujisawa city, pH 7.2, EC 15.5 mS/m, water temperature 24.5° C.) was divided to be 0.5 litter and respectively supplied to the anode chamber 113*a* and the cathode chamber 113*c* of the batch type electrolysis cell 11 (a capacity of the anode chamber and the cathode chamber are both 1 litter) shown in FIG. 4. Then, electrolysis was carried out by applying a direct current voltage so that a constant current of 20A flows to both the electrode plates 115*a* and 115*c*, and a pH and electric conductivity EC of an undiluted solution of anode water obtained at every ten minutes and a diluted solution by diluting the same to be thirty times (30 litters) were measured. Measurement of the diluted water was made after mixing for one minute. The result will be shown in Table 4.

Both of the undiluted detergent and diluted detergent A obtained in the present embodiment became neutral of a pH of 7.0 to 8.0, and the EC value of 100 mS/m or more, so that it becomes preferable to be used as detergent for fibrous washing items, such as silk, wool, cupra, acetate.

TABLE 4

| | undiluted electrolytic solution | | diluting water | |
|---|---|---|---|---|
| | pH | EC (ms/m) | pH | EC (ms/m) |
| before electrolysis | 8.02 | — | — | — |
| after 20 min. | 7.70 | 2000 or more * | 7.82 | 164.5 |
| after 30 min. | 7.70 | 2000 or more * | 7.85 | 133.6 |

Next, an embodiment of comparing detergency on a various kinds of stains will be explained by using the detergent produced by using the method of producing detergent of the present invention and commercially available detergent.

Embodiment 5 (weak alkaline detergent)

In the same way as in the Embodiment 3, a solution prepared by dissolving and diluting 22.5 of sodium hydrogen carbonate in 0.5 litter of tap water (municipal tap water in Fujisawa city, pH 7.2, EC 15.5 mS/m, water temperature 24.5° C.) was supplied to the anode chamber 113*a* and the cathode chamber 113*c* of the batch type electrolysis cell 11

(a capacity of the anode chamber and the cathode chamber are both 0.5 litter) shown in FIG. 4E. Then, electrolysis was carried out by applying a direct current voltage so that a constant current of 20A flows to both the electrode plates 115*a* and 115*c* for 17 minutes. Thus obtained anode water and cathode water were mixed and 1 litter of mixed water was obtained.

A washing tub of a domestic washing machine of double-tub type (trade name of ES-25E, 2.5 kg type, manufactured by Sharp Corp.) was filled with 30 litters of tap water and put in 1000 cc of the above mixed water detergent (diluting rate=30 times). The diluted detergent had a pH of 10.2, EC value of 164.5 mS/m, and a water temperature of 25° C.

A standard stained fabric with "dirt on a collar", and "mixed stain of china ink and olive oil", "blood", "cacao butter (animal and vegetable oil)", "red wine", and "mixed stain of blood, milk and china ink" being allowed to adhere to cotton fabric samples, respectively (EMPA101, 111, 112, 114, 115 and 116), were washed with the washing machine for 12 minutes, spin-dried and dried by a drier.

The detergency ratio of the respective stained fabrics before and after washing is shown in Table 5. Note that the "detergency ratio " was calculated by the formula below.

Detergency ratio %=(whiteness index of stained fabric after washing−whiteness index of stained fabric before washing)÷(whiteness index of unstained fabric−whiteness index of stained fabric before washing)×100

Here, the "whiteness index" is an average of ten points on two sides of the artificially stained fabric measured by a whiteness index measure (trade name of CR-14, Whiteness Index Color Reader, manufactured by Minolta Co.,Ltd.).

COMPARATIVE EXAMPLE 1

As an comparative example of the embodiment 5, the same stained fabrics as in the Embodiment 5 were washed by using a commercially available synthetic detergent for washing (Attack (registered trademark), Kao Corporation) and a whiteness index and the detergency ratio were calculated. The results are shown in Table 5.

TABLE 5

| kind of stained fabric | | detergency ratio | |
|---|---|---|---|
| stained fabric | stain | embodiment 5 | comparative example 1 |
| standard stained fabric | dirt on collar | 49.7 | 44.5 |
| EMPA101 | china ink and olive oil | 11.2 | 8.3 |
| EMPA111 | blood | 81.1 | 44.7 |
| EMPA112 | cacao | 19.6 | 11.7 |
| EMPA114 | red wine | 13.8 | 19.9 |
| EMPA116 | mixed stain of blood, milk and china ink | 15.2 | 13.6 |

From the result, it was confirmed that the weak alkaline detergent (mixed electrolytic water) obtained by the present invention had detergency comparable to or better than the commercially available synthetic detergent. Especially, it is remarkably improved as to blood stain. Note that the detergent of the fifth embodiment had no problems at all concerning safety and treatment of discharging water after washing.

Embodiment 6 (neutral detergent)

A solution prepared by dissolving and diluting 36 g of sodium hydrogen carbonate in 1 litter of tap water (municipal tap water in Fujisawa city, pH 7.2, EC 15.5 mS/m, water temperature 24.5° C.) was supplied to the anode chamber 113*a* and the cathode chamber 113*c* of the batch type electrolysis cell 11 (a capacity of the anode chamber and the cathode chamber are both 1 litter) shown in FIG. 4C, and electrolysis was carried out by applying a direct current voltage so that a constant current of 15A flows to both the electrode plates 115*a* and 115*c* for 36 minutes. When measuring a pH and EC value of thus obtained anode water, pH=7.06 and EC=971 mS/m.

The anode water was further added with 52 g of sodium hydrogen carbonate and additionally added with 3 g of cane sugar fatty acid ester and 2 g of carboxyl methyl cellulose.

A washing tub of a domestic automatic washing machine (trade name of AW-C60VP, 6 kg type, manufactured by Toshiba Corporation) was filled with 31 litters of tap water and put in 1000 cc of the above detergent (diluting rate =31 times). The diluted detergent had a pH of 8.0, EC value of 175.5 mS/m, and a water temperature of 20.1° C.

A standard stained fabric with "dirt on collar", and "mixed stain of china ink and olive oil", "blood", "cacao butter (animal and vegetable oil)", "red wine", and "mixed stain of blood, milk and china ink" being allowed to adhere to cotton fabric samples, respectively (EMPA101, 111, 112, 114, 115 and 116), were washed by setting the water current switch to pressing washing course for 3 minutes (soaked for 5 minutes before washing), rinsed for two times, spin-dried for 4 minutes and dried by a drier.

The detergency ratio of the respective stained fabrics before and after washing is shown in Table 6. note that the "detergency ratio" and "whiteness" were measured and calculated in the same way as in the fifth embodiment.

COMPARATIVE EXAMPLE 2

As a comparative example of Embodiment 6, the same stained fabric as in the Embodiment 6 was washed by using a commercially available neutral detergent for washing (Acron, Lion Corporation) and the detergency ratio was calculated. The results are shown in Table 6.

TABLE 6

| kind of stained fabric | | detergency ratio | |
|---|---|---|---|
| stained fabric | stain | embodiment 6 | comparative example 2 |
| standard stained fabric | dirt on collar | 13.8 | 12.5 |
| EMPA101 | china ink and olive oil | 5.3 | 4.5 |
| EMPA111 | blood | 52.5 | 34.9 |
| EMPA112 | cacao | 3.9 | 6.0 |
| EMPA114 | red wine | 24.3 | 19.7 |
| EMPA116 | mixed stain of blood, milk and china ink | 10.2 | 8.3 |

From the result, it was confirmed that the neutral detergent obtained by the present invention had detergency comparable to or better than the commercially available neutral detergent. Especially, it is remarkably improved as to blood stain. Note that the detergent of the sixth embodiment had no problems at all concerning safety and treatment of discharging water after washing.

What is claimed is:

1. A method of producing detergent comprising:

preparing a solution containing at least one of carbonate or bicarbonate of alkali metal;

supplying the solution to both an anode chamber and a cathode chamber of an electrolysis cell, wherein the cathode chamber and the anode chamber are separated by a diaphragm; and electrolyzing the solution and mixing the resulting cathode water and anode water to obtain the detergent.

2. The method of claim 1, wherein the at least one of carbonate or bicarbonate of alkali metal comprises sodium carbonate.

3. The method of claim 1, wherein the detergent has a pH of 8.5 to 10.5.

4. The method of claim 1, wherein the electric conductivity of the detergent is 100 mS/m or more.

5. The method of claim 1, further comprising diluting the detergent with water.

6. The method of producing detergent as set forth in claim 1, further comprising contacting the detergent with solid carbonate composite which is insoluble or hardly soluble in water.

7. The method of claim 1, further comprising adding washing aid agents to the detergent.

8. The method of claim 7, wherein the washing aid agents include an antisoil redeposition.

9. The method of claim 8, wherein the washing aid agents include at least one of a nonionic surfactant or a dispersion agent.

10. The method of claim 8, wherein the washing aid agents include a water softening agent.

11. The method of claim 1, wherein the at least one of carbonate or bicarbonate of alkali metal comprises sodium hydrogen carbonate, and the detergent has a pH of 8.5 to 10.5 and an electric conductivity of 100 mS/m or more.

12. The method of claim 11, further comprising contacting the detergent with solid carbonate composite which is insoluble or hardly soluble in water.

13. The method of claim 11, further comprising diluting the detergent with water.

14. The method of claim 11, further comprising adding washing aid agents to the detergent.

15. The method of claim 14, wherein the washing aid agents include an antisoil redeposition.

16. The method of claim 15, wherein the washing aid agents include at least one of a nonionic surfactant or a dispersion agent.

17. The method claim 15, wherein the washing aid agents include a water softening agent.

18. A method of producing detergent comprising:

preparing a solution containing at least one of carbonate or bicarbonate of alkali metal;

supplying the solution to both an anode chamber and a cathode chamber of an electrolysis cell, wherein the cathode chamber and the anode chamber are separated by a diaphragm;

electrolyzing the solution and mixing the resulting cathode water and anode water to obtain the detergent;

diluting the detergent with water; and at the time of or after diluting the detergent, adding fatty acid or soap.

19. A method of producing detergent comprising:

preparing a solution comprising sodium hydrogen carbonate;

supplying the solution to both an anode chamber and a cathode chamber of an electrolysis cell, wherein the cathode chamber and the anode chamber are separated by a diaphragm;

electrolyzing the solution and mixing the resulting cathode water and anode water to obtain the detergent;

diluting the detergent with water;

at the time of diluting or after diluting the detergent, adding fatty acid or soap; and the detergent has a pH of 8.5 to 10.5 and an electric conductivity of 100 mS/m or more.

* * * * *